US005836833A

United States Patent [19]

Shimosaka et al.

[11] Patent Number: 5,836,833

[45] Date of Patent: Nov. 17, 1998

[54] GOLF BALL

[75] Inventors: Hirotaka Shimosaka; Keisuke Ihara; Yutaka Masutani; Michio Inoue; Atuki Kasasima, all of Chichibu, Japan

[73] Assignee: Bridgestone Sports Co., Ltd., Tokyo, Japan

[21] Appl. No.: 806,419

[22] Filed: Feb. 26, 1997

[30] Foreign Application Priority Data

Feb. 26, 1996 [JP] Japan ..... 8-063801

[51] Int. Cl.[6] ..... A63B 37/12

[52] U.S. Cl. ..... 473/365; 473/374; 473/385

[58] Field of Search ..... 473/353, 378, 473/365, 374, 385

[56] References Cited

U.S. PATENT DOCUMENTS

| | | | |
|---|---|---|---|
| 2,539,303 | 1/1951 | Gerke et al. | 473/353 X |
| 2,861,810 | 11/1958 | Veatch | 473/353 |
| 4,431,193 | 2/1984 | Nesbitt | 473/374 |
| 5,427,378 | 6/1995 | Murphy | 473/378 X |
| 5,506,004 | 4/1996 | Maruoka et al. | 473/378 X |
| 5,609,535 | 3/1997 | Morgan | 473/378 X |
| 5,674,137 | 10/1997 | Maruko et al. | 473/351 X |

*Primary Examiner*—George J. Marlo

*Attorney, Agent, or Firm*—Sughrue, Mion, Zinn, Macpeak & Seas, PLLC

[57] ABSTRACT

A golf ball comprising a core and a cover including at least two layers is improved in overall performance including flight performance, flight distance, spin, control and feel when an outermost layer of the cover has a gage of 0.01–0.05 mm and a Shore D hardness of 48°–55°. The core may be solid or wound. An inner layer of the cover has a Shore D hardness in the range of 58–70 and a thickness of 1.2–4.0 mm. The outer layer may be a thin film wrapped on the inner layer.

9 Claims, 1 Drawing Sheet

GOLF BALL

BACKGROUND OF THE INVENTION

1. Field of the Invention

This invention relates to a golf ball comprising a core and a cover including at least two layers.

2. Prior Art

In the past, wound golf balls and solid golf balls are manufactured by molding a cover of at least one layer around a wound core or solid core. The cover layer not only plays the role of protecting the core, but also makes a great contribution to flight performance and hitting feel as well as spin and control on approach shots. Golf ball manufacturers conducted numerous research on the material, gage, and structure of the cover layer. Heretofore, golf balls having various covers have been proposed.

In prior art golf balls, most covers are molded from materials having a relatively high hardness as represented by a Shore D hardness of 58° to 70° because of their essential role of ball protection and for the purpose of increasing a flight distance. The covers are relatively thick, that is, have a thickness of 1.5 to 2.5 mm. Then the balls are not necessarily satisfactory in hitting feel and spin when hit with a short iron such as sand wedge. Additionally, upon putting, the player would have an unpleasant or hard hitting feel and hardly get a sense of distance.

The hitting feel and spin of golf balls upon short iron shots and the hitting feel upon putting can be improved by making the cover thinner or softer, but at the sacrifice of flight distance and durability which are important factors for golf balls.

SUMMARY OF THE INVENTION

An object of the present invention is to provide a golf ball which is improved in flight performance and flight distance, which gains a satisfactory spin rate to run short when hit with a short iron such as sand wedge, which is improved in control upon approach shots, and which gives a soft feel to the player upon putting.

In connection with a golf ball comprising a core and a cover including at least two layers, the inventors have found that when an outermost layer of the cover is formed from a soft resin material having a Shore D hardness of up to 55° to a gage of up to 0.05 mm, the hitting feel and spin characteristics upon short iron shots are improved to facilitate the control on approach at no sacrifice of flight performance. Additionally, upon putter shots the hitting feel is soft so that the player may get a sense of distance. A cover inner layer having a sufficient thickness and hardness to ensure a satisfactory flight distance and durability and the outermost layer which is soft and thin enough to improve the hitting feel and spin cooperate to provide a golf ball having improved overall performance.

According to the present invention, there is provided a golf ball comprising a core and a cover. The cover includes at least an outermost layer and an inner layer. The outermost layer has a gage of up to 0.05 mm and a Shore D hardness of up to 55°.

DESCRIPTION OF THE PREFERRED EMBODIMENTS

Figure 1:
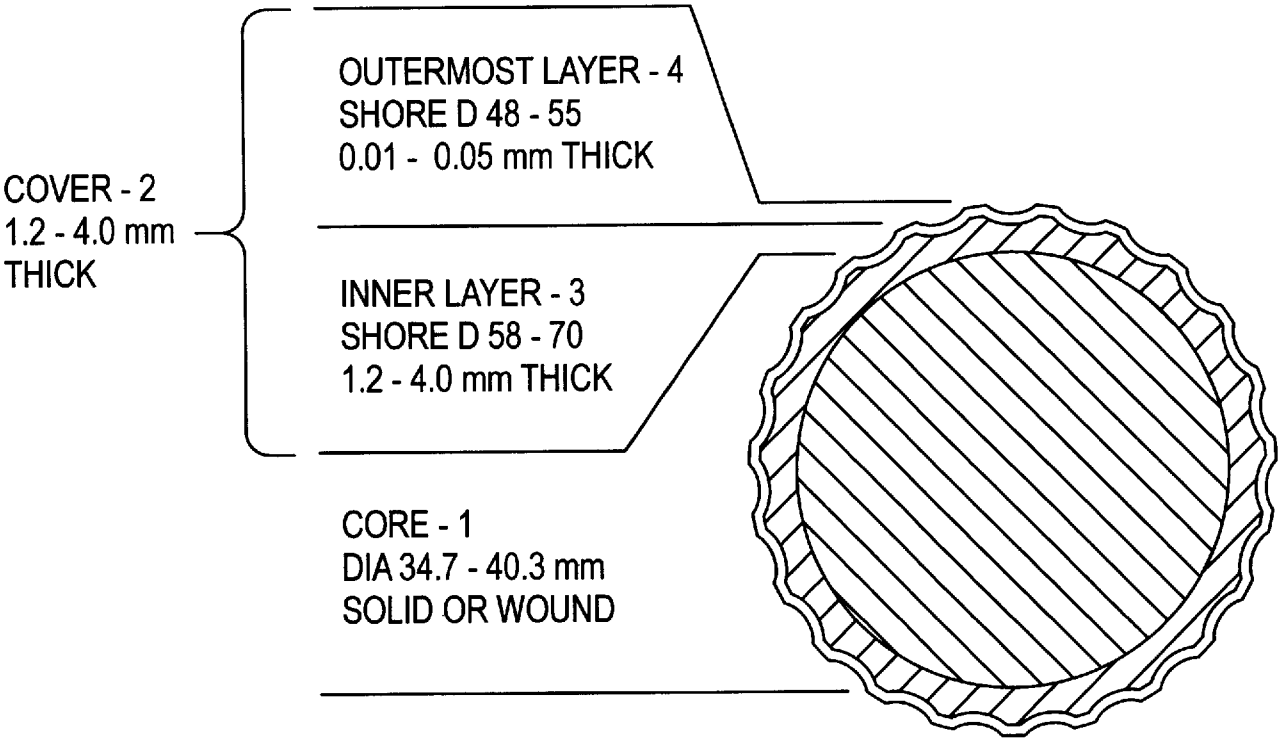
FIG. 1 is a cross section of a golf ball in accordance with this invention.

The present invention is directed to a golf ball comprising a core 1 and a cover 2 enclosing the core. The cover includes at least two layers, that is, at least an outermost layer 4 and an inner layer 3. The outermost layer 4 has a gage of up to 0.05 mm and a Shore D hardness of up to 55°.

The core 1 to be enclosed with the cover is not critical. The golf ball may be either a wound golf ball using a wound core or a solid golf ball using a solid core although the invention is more advantageously applicable to solid golf balls. The wound core and solid core used herein may be the same as conventional wound cores and solid cores. Cores formed from well-known materials by conventional methods may be used. The weight, diameter and hardness of the wound or solid core may be properly adjusted insofar as the objects of the invention are attained. Typically the core 1 has a diameter of 34.7 to 40.3 mm, especially 37.1 to 39.3 mm.

The cover 2 is molded over the core to a gage (or radial thickness) of 1.2 to 4 mm, especially 1.7 to 2.8 mm depending on the diameter of the core and other parameters. According to the invention, the cover has a structure including at least two layers, preferably two to four layers, more preferably two layers. Differently stated, the cover includes an outermost layer and one or more inner layers 3. The one or more inner layers may be formed from well-known cover stocks by conventional methods so as to ensure a satisfactory flight distance and durability. Typically, using resin materials, for example, ionomer resins, polyester elastomers, polyamide elastomers, and polyurethane elastomers, the inner layer(s) having a Shore D hardness of 58° to 70°, especially 60° to 65° may be formed to a gage of 1.2 to 4.0 mm, especially 1.7 to 2.8 mm.

Formed on the cover inner layer 3 is the outermost layer 4 which is a soft and very thin layer having a Shore D hardness of up to 55°, preferably 48° to 52° and a gage of up to 0.05 mm, preferably 0.01 to 0.05 mm. By forming such a soft and very thin outermost layer, spin and hitting feel can be improved without sacrificing the flight performance attributable to the restitution the cover inner layer and core possess. Insofar as the above-mentioned physical properties are met, the cover outermost layer may be formed of any desired material which is selected from, for example, ionomer resins, polyurethane elastomers, and ethylene-vinyl acetate (EVA) copolymers. An ionomer resin is preferred.

The cover including the outermost layer and the inner layer may be formed on the core by a properly selected one of conventional methods depending on whether the core is a wound core or a solid core. Typical methods include a heat compression molding method comprising the steps of preforming a pair of hemi-spherical half cups from a resinous cover stock, enclosing a core with the half cups and molding the cups to the core under heat and pressure and an injection molding method comprising the steps of placing a core in a mold cavity and injection molding a cover stock around the core. Using such molding methods, the cover inner layer(s) and the cover outermost layer may be successively formed. However, since the outermost layer is as thin as 0.05 mm or less, it is sometimes difficult for conventional methods to form the outermost layer of a uniform thickness. Then in one preferred embodiment, the cover outermost layer is formed by preparing a resin film having a gage of up to 0.05 mm, especially 0.01 to 0.05 mm from a cover stock, and wrapping the core having the cover inner layer formed thereon with the film, followed by heat compression molding. This procedure ensures that a very thin cover outermost layer be formed to a uniform gage of up to 0.05 mm.

For conventional golf balls, it is a common practice to form a coating of urethane or acrylic resin on the cover surface as by spraying. Unlike the coating, the cover outermost layer according to the invention is formed by a molding method and constitutes a part of the cover. Since the outermost layer is very thin as mentioned above, it may serve as a finish layer providing the same function as a conventional coating. Then the conventional coating may be omitted in the practice of the invention.

The respective cover layers may be formed of different resins although the cover layers are preferably formed of resin materials of the same type, but having different physical properties (typically, hardness). Then the respective layers can be laminated while a firm bond is established therebetween. In one preferred embodiment, the cover inner layer to outermost layer are formed using a plurality of ionomer resins having different physical properties (typically, hardness).

The golf ball of the invention may be provided on the surface with a multiplicity of dimples in a conventional manner. If a mold having a negative dimple pattern on its cavity surface is used for cover molding, dimples may be configured at the same time as injection molding of the cover or indented at the same time as heat compression molding of the cover.

Other than the above-mentioned features, the golf ball of the invention may have the same construction as conventional golf balls. The application of a conventional coating may be omitted as previously mentioned although it is, of course, acceptable to apply a coating as a finish layer as in the prior art. With respect to the diameter and weight of the golf ball, a proper choice may be made in accordance with the Rules of Golf.

There has been described a golf ball wherein the cover includes at least two layers, among which an outermost layer is formed as a thin layer with a gage of up to 0.05 mm from a soft resin material having a Shore D hardness of up to 55°. A cover inner layer 3 is thick and hard enough to ensure a satisfactory flight distance and durability. The outermost layer 4 is soft and thin enough to offer a soft hitting feel and satisfactory spin at no sacrifice of the performance inherent to the inner layer. Thus the golf ball possesses superior overall performance.

More specifically, the golf ball of the invention has the following benefits. When hit with a wood club such as driver or a long iron, the golf ball will travel a satisfactory flight distance. When hit with a short iron such as sand wedge, the ball not only travels a satisfactory flight distance, but also gains such a spin rate that the ball may stop short after landing on the green. Then on an approach shot, the player can hit the ball directly to the pin with the intention that the ball will travel only a carry to the pin. Additionally, upon putter shots the hitting feel is so soft that the player may get a sense of distance.

EXAMPLE

Examples of the present invention are given below by way of illustration and not by way of limitation. All parts are by weight.

Examples 1–2 & Comparative Examples 1–3

Solid golf balls were prepared. A solid core having an outer diameter of 38.9 mm was first prepared by kneading a rubber composition of the formulation shown below and molding and vulcanizing the composition at 155° C. for 15 minutes.

| Core-forming rubber composition | Parts by weight |
|---|---|
| Cis-1,4-polybutadiene | 100 |
| Zinc acrylate | 24 |
| Zinc oxide | 19 |
| Anti-oxidant | 1 |
| Dicumyl peroxide | 1 |

A cover as shown in Table 1 was formed on the core. There were obtained five golf balls, three golf balls (Examples 1–2 and Comparative Example 3) having a cover of two layer structure and two golf balls (Comparative Examples 1–2) having a single layer cover. The inner layer of the two-layer cover and the single layer cover were formed around the core by injection molding. The outer layer of the two-layer cover was formed by wrapping the core having the inner layer molded thereon with a film of cover stock and heat compression molding the film to the core.

The golf balls were evaluated for flight performance and putting feel by hitting tests using a driver, sand wedge, and putter. The test procedures are described below.

Flight performance

Using a swing robot by True Temper Co., a ball was hit with a driver (W#1) at a head speed of 45 m/sec. (HS=45) and with a sand wedge (SW) at a head speed of 19 m/sec. (HS=19). The initial velocity (IV, m/sec.), carry (m) and total distance (m) were measured. In the sand wedge test, the run (m) was calculated as the total distance (m) minus the carry (m).

Putting feel

Three professional golfers (A, B and C) hit a ball with a putter for evaluating the putting feel according to the following criterion.

◎: very soft

○: soft

Δ: somewhat hard

The results are shown in Table 1.

TABLE 1

| | | Cover | | W#1 HS = 45 | | | SW HS = 19 | | | | Putting feel | | |
|---|---|---|---|---|---|---|---|---|---|---|---|---|---|
| | | Inner layer | Outer layer | IV | Carry | Total | IV | Carry | Run | Total | A | B | C |
| E1 | Material | Ionomer | Ionomer | 65.5 | 215 | 235 | 19.4 | 33 | 6 | 39 | ◎ | ◎ | ◎ |
| | Gage (mm) | 1.9 | 0.050 | | | | | | | | | | |
| | Hardness (°) | 64 | 45 | | | | | | | | | | |
| E2 | Material | Ionomer | Ionomer | 65.6 | 216 | 237 | 19.5 | 34 | 6 | 40 | ◎ | ○ | ◎ |
| | Gage (mm) | 1.9 | 0.020 | | | | | | | | | | |

TABLE 1-continued

| | | Cover | | | | | | | | | Putting | | |
|---|---|---|---|---|---|---|---|---|---|---|---|---|---|
| | | Inner | Outer | W#1 HS = 45 | | | SW HS = 19 | | | | feel | | |
| | | layer | layer | IV | Carry | Total | IV | Carry | Run | Total | A | B | C |
| | Hardness (°) | 64 | 45 | | | | | | | | | | |
| CE1 | Material | | Ionomer | 65.6 | 217 | 236 | 19.6 | 33 | 10 | 43 | Δ | Δ | Δ |
| | Gage (mm) | | 1.9 | | | | | | | | | | |
| | Hardness (°) | | 64 | | | | | | | | | | |
| CE2 | Material | | Ionomer | 65.1 | 210 | 225 | 19.2 | 30 | 5 | 35 | ⊚ | ⊚ | ○ |
| | Gage (mm) | | 1.9 | | | | | | | | | | |
| | Hardness (°) | | 45 | | | | | | | | | | |
| CE3 | Material | Ionomer | Ionomer | 65.4 | 215 | 234 | 19.3 | 30 | 6 | 36 | ⊚ | ⊚ | ⊚ |
| | Gage (mm) | 1.9 | 0.300 | | | | | | | | | | |
| | Hardness (°) | 64 | 45 | | | | | | | | | | |

Note that in the context of the invention, the cover outer layer 4 is the outermost layer of the cover and the cover inner layer is the second layer of the cover as counted from the outside.

It is evident from Table 1 that the golf balls within the scope of the invention (Examples 1 and 2) show a superior overall profile of performance in that they travel a satisfactory distance, that when hit with a sand wedge, they run short, namely, are likely to stop short after landing, and that they offer a pleasant feel on putting.

In contrast, the golf ball of Comparative Example 1 free of a thin soft cover outermost layer travels a satisfactory distance, but yields a long run upon sand wedge shots (difficult to hit a short stopping ball) and unpleasant feel upon putting. The golf ball of Comparative Example 2 having a relatively soft single cover layer is satisfactory in short stopping upon sand wedge shots and putting feel, but is remarkably reduced in flight distance. The golf ball of Comparative Example 3 having a rather thick cover outermost layer is satisfactory in short stopping upon sand wedge shots and putting feel, but is reduced in flight distance because the thick outermost layer prevents the ball from taking full advantage of the cover inner layer and core.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising, a core and a cover, the cover comprising at least an outermost layer and an inner layers wherein the outermost layer has a gage of 0.01 to 0.05 mm and a Shore D hardness of 48° to 55°, the inner laver having a gage of 1.2 to 4.0 mm and a Shore D hardness of 58° to 70°, and the outermost layer is a film selected from the group consisting of ionomer resins, polyurethane elastomers and ethylene-vinyl acetate copolymers.

2. The golf ball of claim 1 wherein the outermost layer has a gage of 0.01 to 0.05 mm and a Shore D hardness of 48° to 55°.

3. The golf ball of claim 1 which is a solid golf ball wherein the core is a solid core.

4. The golf ball of claim 1 wherein said core has a diameter in the range of 34.7 to 40.3 mm.

5. The golf ball of claim 1 wherein said inner layer has a thickness in the range of 1.7 to 2.8 mm.

6. The golf ball of claim 1 wherein said inner layer has a Shore D hardness in the range of 60 to 65.

7. The golf ball of claim 1 wherein said outermost layer has a Shore D hardness in the range of 48 to 52.

8. The golf ball of claim 1 wherein said outermost layer comprises an ionomer resin film wrapped on said inner layer.

9. The golf ball of claim 1 wherein said core is a wound core.

* * * * *